US007491099B2

(12) United States Patent
Zinell et al.

(10) Patent No.: US 7,491,099 B2
(45) Date of Patent: Feb. 17, 2009

(54) PRESSURETIGHT CONTACT CONNECTION FOR FUZE ELECTRONICS

(75) Inventors: Alexander Zinell, Villingen-Schwenningen (DE); Martin Leonhardt, Aichhalden (DE); Frank Kienzler, VS-Villingen (DE); Egon Klaussner, Schramberg (DE)

(73) Assignee: Junghans Feinwerktechnik GmbH & Co., KG, Schramberg (DE)

( * ) Notice: Subject to any disclaimer, the term of this patent is extended or adjusted under 35 U.S.C. 154(b) by 344 days.

(21) Appl. No.: 11/431,963

(22) Filed: May 11, 2006

(65) Prior Publication Data

US 2006/0288852 A1 Dec. 28, 2006

(30) Foreign Application Priority Data

Jun. 24, 2005 (DE) ..... 10 2005 029 325

(51) Int. Cl.
*H01R 13/187* (2006.01)

(52) U.S. Cl. ..... 439/843; 439/748; 439/749; 439/851; 439/439; 439/855

(58) Field of Classification Search ..... 439/748, 439/749, 843, 844, 851, 854, 855, 859, 860, 439/902, 439

See application file for complete search history.

(56) References Cited

U.S. PATENT DOCUMENTS 3,218,605 A * 11/1965 Wanlass ..... 439/749
3,605,076 A 9/1971 Dozier
4,002,400 A * 1/1977 Evans ..... 439/748
4,056,299 A * 11/1977 Paige ..... 439/439
4,749,357 A * 6/1988 Foley ..... 439/80
4,906,211 A * 3/1990 Bell et al. ..... 439/851
4,950,173 A 8/1990 Minemura et al.
5,707,243 A * 1/1998 Endo et al. ..... 439/76.2
6,607,409 B2 8/2003 Machado
2003/0013352 A1 1/2003 Machado
2004/0129550 A1 7/2004 Bodet et al.

FOREIGN PATENT DOCUMENTS

DE 197 30 603 A1 7/1997
DE 197 35 409 C2 8/1997
DE 299 03 992 U1 3/1999
GB EP 0 892 463 A2 1/1999

* cited by examiner

*Primary Examiner*—Tho D Ta
(74) *Attorney, Agent, or Firm*—Scully, Scott, Murphy & Presser, P.C.

(57) ABSTRACT

A pressuretight contact connection for the programming and power supply for fuze electronics is described, which is provided in a housing (10) from which a contact pin (34) projects in an electrically insulated and pressuretight manner in order to make contact with a connecting element (12). The connecting element (12) has a contact surface element (16), which is provided in an insulating housing (14) and has contact fingers (24) in the area of a through-hole (18) which is formed in the insulating housing (14), which contact fingers (24) clasp the contact pin (34) in an interlocking manner when the connecting element (12) and the housing (10) of the fuze electronics are in the mated contact state.

9 Claims, 1 Drawing Sheet

PRESSURETIGHT CONTACT CONNECTION FOR FUZE ELECTRONICS

BACKGROUND OF THE INVENTION

1. Field of the Invention

The invention relates to a pressuretight contact connection for the programming and power supply for fuze electronics, which is provided in a housing.

2. Discussion of the Prior Art

Plug connections are known for temporarily making contact for the programming and power supply for fuze electronics. Plug connections such as these may have defects in terms of pressure tightness.

A contact connection such as this is used to maintain the appropriate electrical contact until completion of the programming and power supply. In this case, this temporary electrical contact is intended to withstand environmental loads and, in particular, supply loads. The known plug connections may also have defects in this respect.

SUMMARY OF THE INVNETION

With the knowledge of these characteristics, the invention is based on the object of providing a contact connection, which is pressuretight for gases, of the type mentioned initially, which withstand the propellant charge gas pressure that occurs during firing, with the contact being reliably ensured, that is to say maintained, against environmental and supply loads, until completion of the programming and power supply.

According to the invention, this object is achieved by the features of the disclosure, as claimed herein. Preferred refinements and developments of the contact connection according to the invention, which is pressuretight for gases, are set forth in the dependent claims.

BRIEF DESCRIPTION OF THE DRAWINGS

One exemplary embodiment of the contact connection according to the invention, which is pressuretight for gases, is described in the following details with reference to the drawing figures, wherein.

DETAILED DESCRIPTION OF THE INVENTION

Figure 1:
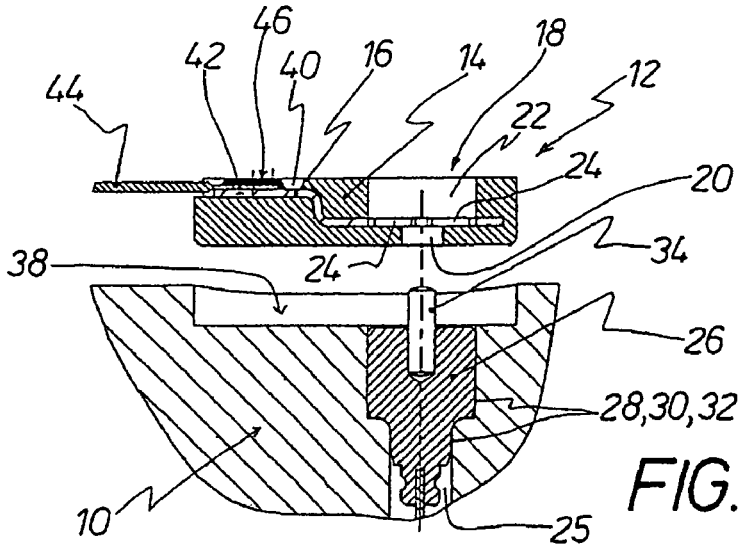
FIG. 1 shows a section illustration of a detail of one embodiment of the contact connection, before contact is made between the connecting element and the contact pin of fuze electronics.

FIG. 1 shows a section illustration of a part of a housing 10 for fuze electronics, and a connecting element 12, which is shown at a distance from the housing 10, for the fuze electronics, for its programming and power supply. The connecting element 12 has a contact surface element 16 in an insulating housing 14, that is to say the contact surface element 16 is extrusion-coated with the insulating housing 14. The insulating housing 14 is composed of a suitable plastic material.

Figure 3:
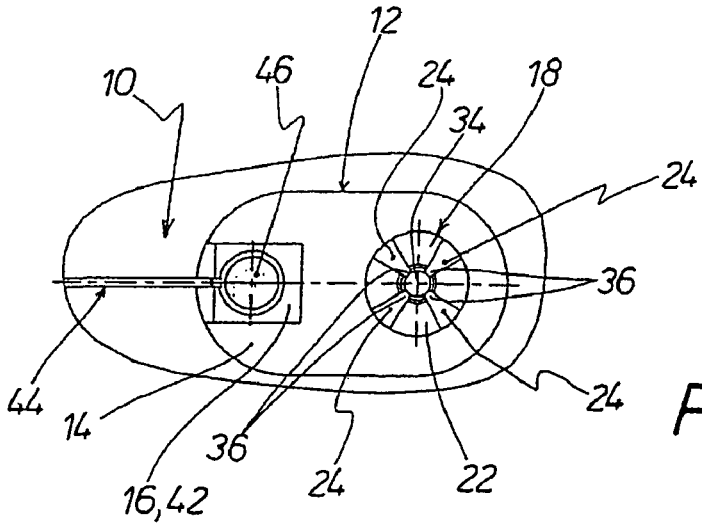
FIG. 3 shows a view looking in the direction of the arrow III in FIG. 2, that is to say a plan view of the connecting element and of the housing, part of which is shown, of the fuze electronics in the temporary contact state.

The insulating housing 14 is formed with a stepped through-hole 18, which has a first hole section 20 and a second hole section 22. The contact surface element 16 is formed with contact fingers 24 in the area of the through-hole 18 in the insulating housing 14, which contact fingers 24 are spaced apart from one another uniformly in the circumferential direction, as can be seen in FIG. 3.

The housing 10 for the fuze electronics (which are not illustrated) is formed with a stepped hole 24. A pressed body 26 is fixed in the stepped hole 24 such that it cannot move axially. The pressed body 26 may be composed of a metal, a metal alloy or an insulating material. This insulating material may be glass or ceramic. If the pressed body 26 is composed of a metal or a metal alloy, then an insulating layer 32 is provided between the outer surface 28 of the pressed body 26 and the inner surface 30 of the housing 10 in order to electrically isolate it from the housing 10 of the fuze electronics. This insulating layer 32 can be provided on the outer surface 28 of the pressed body 26 and/or on the inner surface 30 of the housing 10.

A contact pin 34 projects from the pressed body 26 and is electrically conductively connected to the fuze electronics (which are not shown).

Figure 2:
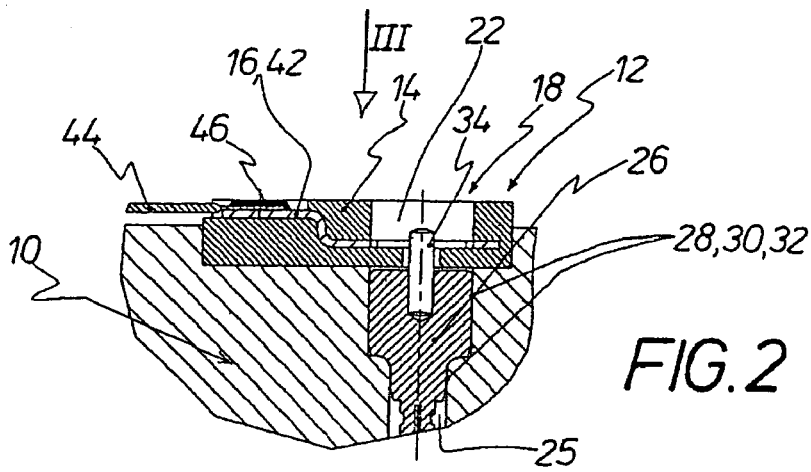
FIG. 2 shows a detail of a section illustration, corresponding to FIG. 1, of the contact connection after contact has been made between the connecting element and the contact pin of the fuze electronics.

When the connecting element 12 is in the mated contact state with the housing 10 of the fuze electronics, as is illustrated in FIG. 2, the contact fingers 24 of the contact surface element 16 are bent slightly in a sprung manner, and clasp the contact pin 34 in an interlocking manner, thus providing a reliable electrical contact between the contact surface element 16 and the fuze electronics via the contact pin 34. For this purpose; the front edges 36 of the contact fingers 24 define an unobstructed circumferential rim, which is slightly smaller than the rim profile of the cross section of the contact pin 34.

The housing 10 of the fuze electronics has a recess 38 (see FIG. 1), from which the contact pin 34 projects. The insulating housing 14 of the connecting element 12 can be pressed in an interlocking manner into the recess 38 in the housing 10 of the fuze electronics. On firing, the connecting element 12, that is to say its insulating housing 14, can be detached from the recess 38 that is formed in the housing 10, because the connecting element 12 has carried out its function of supplying the fuze electronics with programming data and with electrical power until this time.

The insulating housing 14 of the connecting element 12 has a cutout 40 for a contact section 42 of the contact surface element 16. A connecting cable 44 is connected to the contact section 42. This connection is a fixed connection 46, for example a welded joint.

In FIGS. 1 to 3, the same details are in each case provided with the same reference numbers, so that there is no need to describe all of the details in conjunction with each of the figures.

List Of Reference Numbers

10 Housing
12 Connecting element
14 Insulating housing (of 12)
16 Contact surface element (in 14)
18 Through-hole (in 14 for 34 and 24)
20 First hole section (of 18)
22 Second hole section (of 18)
24 Contact finger (of 16 for 34)
25 Hole (in 10 for 26)
26 Pressed body (in 25 for 34)
28 Outer surface (of 26)

30 Inner surface (of 25)
32 Insulating layer (between 28 and 30)
34 Contact pin (on 26 for 12)
36 Front edge (of 24)
38 Recess (in 10 for 14)
40 Cutout (in 14 for 46)
42 Contact section (of 16 for 44)
44 Connecting cable (of 12)
46 Fixed connection (between 44 and 42)

What is claimed is:

1. A pressuretight contact connection for the programming and power supply for fuze electronics, wherein, the fuze electronics for the programming data and power supply is arranged in a housing (10), a contact pin (34) projecting in an electrically insulated and pressuretight manner from the housing (10) for contacting with a connecting element (12), the connecting element (12) having a contact surface element (16) which is located in an insulating housing (14) and has contact fingers (24) in a region of a through-hole (18) which is formed in the insulating housing (14), said contact fingers (24) clasping the contact pin (34) in an interlocking engagement when the connecting element (12) and the housing (10) of the fuze electronics are in a mating contact state, the housing (10) of the fuze electronics including a recess (38) from which the contact pin (34) projects, the insulating housing (14) of the connecting element (12) is pressable in an interlocking manner into the recess (38) in the housing (10) of the fine electronics, and the contact pin (34) projects from a pressed body (26), which is fixed pressuretightly in the housing (10) of the fuze electronics.

2. A pressuretight contact connection according to claim 1, wherein the front edges (36) of the contact fingers (24) from an unobstructed rim, which is slightly smaller than the cross section of the contact pin (34).

3. A pressuretight contact connection according to claim 1, wherein the pressed body (26) is composed of a metal and is electrically isolated from the housing (10) of the fuze electronics by an insulating layer (32).

4. A pressuretight contact connection according to claim 1, wherein the insulating housing (14) of the connecting element (12) is composed of a plastic material.

5. A pressuretight contact connection according to claim 1, wherein the through-hole (18) has the form of a stepped through-hole with a hole section (20) thereof facing the contact pin (34) including an unobstructed cross section which is smaller than the unobstructed cross section of a hole section (22) facing away from the contact pin (34).

6. A pressuretight contact connection according to claim 5, wherein the hole section (20) facing the contact pin (34) has an unobstructed cross section, which is slightly larger than the cross section of the contact pin (34).

7. A pressuretight contact connection according to claim 5, wherein the hole section (22) facing away from the contact pin (34) has an unobstructed cross section, which is matched or slightly larger than a root rim of the contact fingers (24), or is slightly larger than it.

8. A pressuretight contact connection according to claim 1, wherein the pressed body (26) is composed of an insulating material.

9. A pressuretight contact connection according to claim 8, wherein the pressed body (26) is composed of glass or ceramic.

* * * * *